US006936138B2

(12) United States Patent
Attenberger et al.

(10) Patent No.: US 6,936,138 B2
(45) Date of Patent: Aug. 30, 2005

(54) APPARATUS FOR INCORPORATING FEATURE SUBSTANCES INTO A PAPER WEB

(75) Inventors: Thomas Attenberger, Poing (DE); Gerhard Stenzel, Munich (DE); Ralf Soltau, Moosach (DE); Manfred Hutmann, Planegg (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 10/132,470

(22) Filed: Apr. 26, 2002

(65) Prior Publication Data

US 2002/0166647 A1 Nov. 14, 2002

(30) Foreign Application Priority Data

Apr. 27, 2001 (DE) ..... 101 20 818

(51) Int. Cl.[7] ..... D21H 23/22

(52) U.S. Cl. ..... 162/265; 162/263; 162/363; 118/314; 118/315; 118/323; 118/325; 239/76; 239/96; 239/398; 239/410; 239/650

(58) Field of Search ..... 162/134–137, 162/140, 162, 252, 263, 265, 198, 363; 118/300, 314, 323–325; 239/76, 96, 398, 410, 650; 427/475, 424, 479–485, 358–359, 207.1, 361, 391

(56) References Cited

U.S. PATENT DOCUMENTS

| | | | | | |
|---|---|---|---|---|---|
| 1,281,951 | A | * | 10/1918 | Harper | 162/134 |
| 2,711,120 | A | * | 6/1955 | Maclaurin | 162/110 |
| 3,291,631 | A | * | 12/1966 | Smith | 427/195 |
| 4,320,583 | A | * | 3/1982 | Dove | 34/568 |
| 4,504,357 | A | * | 3/1985 | Holbein et al. | 162/123 |
| 4,944,960 | A | * | 7/1990 | Sundholm et al. | 427/474 |
| 5,264,036 | A | | 11/1993 | Haas et al. | |
| 5,279,854 | A | * | 1/1994 | Kendall et al. | 427/197 |
| 5,887,459 | A | * | 3/1999 | Fleissner | 68/205 R |
| 5,897,746 | A | | 4/1999 | Attenberger et al. | |
| 5,919,524 | A | * | 7/1999 | Paloviita et al. | 427/348 |
| 6,063,450 | A | | 5/2000 | Bernert et al. | |
| 6,410,100 | B1 | | 6/2002 | Bernert et al. | |
| 6,451,168 | B1 | * | 9/2002 | Talja | 162/134 |
| 6,494,954 | B1 | | 12/2002 | Bernert et al. | |
| 2002/0166647 | A1 | * | 11/2002 | Attenberger et al. | 162/135 |
| 2003/0096061 | A1 | * | 5/2003 | Garg et al. | 427/361 |
| 2003/0118847 | A1 | * | 6/2003 | Chuang et al. | 428/447 |
| 2003/0221808 | A1 | * | 12/2003 | Capizzi | 162/135 |
| 2004/0079502 | A1 | * | 4/2004 | Capizzi | 162/135 |
| 2004/0099392 | A1 | * | 5/2004 | Liu et al. | 162/184 |

FOREIGN PATENT DOCUMENTS

| | | |
|---|---|---|
| DE | 497037 | 5/1930 |
| DE | 19754776 | 6/1999 |
| EP | 580363 | 1/1994 |
| EP | 812952 | 12/1997 |
| EP | 1074599 | 2/2001 |
| GB | 643430 | 9/1950 |
| GB | 696673 | 9/1953 |

* cited by examiner

*Primary Examiner*—José A. Fortuna
(74) *Attorney, Agent, or Firm*—Bacon & Thomas, PLLC

(57) ABSTRACT

A method and apparatus for incorporating feature substances into a still moist but already sufficiently consolidated paper web provides for directing a feature substance suspension onto the surface of the paper web as a laminar jet with low jet pressure. A special pressure control circuit ensures that the jet pressure is always constant regardless of the number of parallel feature substance suspension jets directed onto the paper web. This makes it possible to incorporate a great variety of line codings in paper under the same process conditions without any visible changes in fiber structure occurring in the paper.

16 Claims, 1 Drawing Sheet

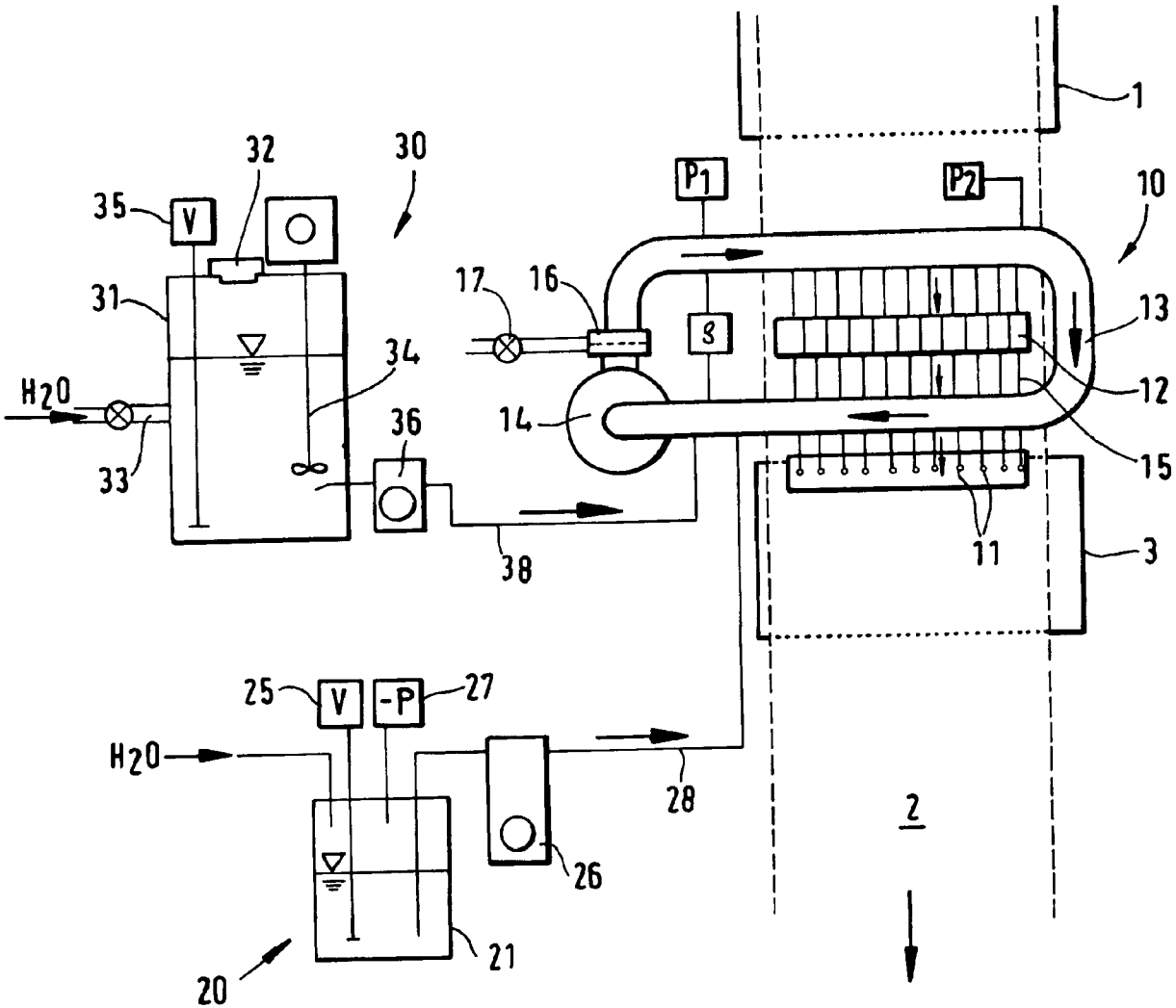
1
10
13
12
15
3
P2
11
2
P1
S
16
17
14
38
28
26
27
-P
V
25
21
20
H2O
30
34
36
32
V
35
31
33
H2O

APPARATUS FOR INCORPORATING FEATURE SUBSTANCES INTO A PAPER WEB

BACKGROUND

This invention relates to a method and apparatus for incorporating feature substances into a paper web and to a paper machine having such an apparatus.

It is known to incorporate feature substances into documents of value made of paper, in particular bank notes, as security features, for example luminescent particles fluorescing in a characteristic color under suitable excitation radiation such as UV light. Feature substances refer here in general to substances with certain physical properties whose presence and/or arrangement can be checked due to these properties by measurement technology, for example by suitable sensors. Such features are usually placed at defined positions in the paper as characters, patterns or lines.

It is known for example from DE-A-197 54 776 to spray colored patterns with sharp contours onto finished paper in linear form so as to produce graphic security features recognizable to the naked eye. Said security features are deposited on the surface of the paper and are therefore not only visible but also tangible. In particular when using luminescent substances whose color effects are only recognizable under certain excitation conditions, however, it is desirable that their place of incorporation is inconspicuous to the casual viewer and in particular to possible forgers.

UK-A-696 673 proposes for example injecting coloring pigments in a suspension liquid immiscible with water into the center of the sheet from a jet or nozzle during sheet formation to produce dotted lines or continuous pipes, for example of material fluorescent in UV light. However, since the fluorescent suspension spreads at least partially and uncontrollably in the not yet fully dipped paper material, the contours of such lines are blurred and the pigment concentration is uneven across the line width.

DE-C-497 037, in contrast, proposes applying, for example spraying, a suspension with fluorescent substances onto the fully dipped, still moist paper web in such a way that the paper structure itself does not undergo any appreciable change. However, spraying also leads to patterns whose contour acuity is difficult to control and whose feature concentration is inconstant across the surface of the pattern.

These disadvantages are partly overcome by the method described in UK-C 643 430 wherein an endless metal band with stencil-like gaps is moved together with the arising paper web and the colored feature substances are sprayed on diffusely so as to penetrate into the paper web in the area of the stencil-like gaps. However, this also fails to obtain a sufficiently homogeneous distribution of feature substances, as EP-A0 659 935 criticizes.

EP-A-0 659 935 instead proposes dispersing feature substances not in suspension but in gas, so that agglomerates of feature particles readily break down and are present in the gas in a defined, homogeneous concentration, to then be sprayed onto the still wet paper web by a nozzle. This is said to achieve a homogeneous distribution in paper at the same time as relatively sharp contours even at low feature concentrations.

The disadvantage of this aerosol application of the particles is that only few feature substances are suitable for application in aerosol form since the pipes and nozzles are easily clogged. This applies in particular to fine-grained feature substances which tend to agglomerate. Furthermore, test results have shown relatively high fluctuations in concentration so that a high feature concentration is necessary for obtaining reliably measurable features.

SUMMARY

The problem of the present invention is therefore to propose a method and apparatus as well as a corresponding paper machine which make it possible to incorporate feature substances into paper in patterns or tracks with sharp contours and concentrations as uniform as possible across the pattern surface, even if they are low, without this resulting in changes of the fiber structure of the paper which are visible to the eye.

This problem is solved by a method and apparatus as well as a paper machine having the features stated in the independent claims. Preferred developments and embodiments of the invention are stated in claims dependent thereon.

As in DE-C 497 037, the feature substances are, according to the present invention, incorporated into the paper web during the papermaking process at a time when the bulk of the liquid is already withdrawn from the original paper pulp, i.e. the paper web is still moist but already consolidated, by applying a feature substance suspension to the still moist paper web in such a way that the paper web does not undergo any change in fiber structure. In order to achieve this, the feature substance suspension is directed onto the surface of the paper web as a laminar jet with low jet pressure. The feature substance suspension flows onto the paper web at low pressure.

The low jet pressure, this referring to the pressure on the inlet side of a nozzle, prevents the fiber structure of the paper web from changing upon application of the feature substance suspension. Accordingly, the place where the feature substance suspension is applied is invisible to the naked eye on the finished paper, even in transmitted light. Therefore, the method can also be used for incorporating feature substances in the watermark area.

A jet pressure on the nozzle inlet side in the range of about 30 to 200 millibars, preferably 50 to 100 millibars, has proved especially suitable. A nozzle inlet pressure therebelow leads to uneven and unstable jet formation and to deposits of feature substance in the feed pipes, while a higher nozzle inlet pressure from about 250 millibars upward leads to structural changes in the fibrous web of the paper web. The outlet nozzles themselves can be designed very simply, for example as metal or ceramic tubes. However, it is especially suitable to use so-called solid jet nozzles or flat jet nozzles which discharge the feature substance suspension as a solid jet with a circular or flat cross section.

The extension of width of the feature track is empirically determinable, and almost constant if the quantity of suspension is supplied constantly. The patterns produced thereby therefore have sharp contours. Since the suspension jet directed onto the paper web penetrates the wet and still soft paper layer uniformly, the quantity of suspension applied is roughly constant across the surface. As a result, the feature concentration is almost homogeneous across the width of the produced pattern, regardless of how high the feature concentration in the suspension is. This makes it possible to produce patterns even with the lowest feature concentrations distributed homogeneously over the pattern surface. The feature concentration of the produced patterns can be so low that the features are invisible to the naked eye and only detectable by machine using suitable sensors.

Since the feature substances are incorporated on a liquid basis, one can use almost any type of feature substances which are dispersible or soluble in a suitable suspending medium. Even high-density pigments can thus be incorporated uniformly into the paper web. Incorporating the feature substances by means of solid jets has the further advantage over spraying methods that no mist occurs. Thus the equipment used does not soil as easily and there are fewer problems with the deposit of particles on the nozzles.

The feature substances are preferably dispersed in water since water is available anytime, inexpensive, safe and chemically neutral. This does not exclude the use of other liquids such as alcohol. Especially suitable feature substances are luminescent pigments which are only recognizable under special excitation conditions such as UV light, so that the feature patterns incorporated into the paper are not readily visible in daylight. However, magnetic feature substances or ones absorbent in certain wave ranges can also be processed with the inventive method and apparatus.

The laminar feature substance suspension jet is preferably directed onto the paper web directly after sheet formation and removal of the still soft paper web from the mold, since at this point the paper web is sufficiently consolidated but still so moist that the suspension with the feature substances can penetrate into the paper web without leaving any traces. A special embodiment provides that a suction device in the form of a separate suction box is disposed at a following place in the paper machine in the direction of transport of the paper web for sucking the suspending medium through the paper web. This promotes the feature substances being present not only in near-surface areas of the paper but distributed throughout the paper thickness.

The volume should have a certain size since it serves as a buffer volume which compensates for fluctuations in the concentration of the feature substance in the volume which are caused by the supply of further feature substance concentrate and suspending medium into the volume. Said volume must not be too great, on the other hand, since otherwise any changes to be made in the set point of the feature substance concentration last too long. It has proved expedient to select the size of the volume so that an exchange or the throughput of the volume through the nozzles lasts about 15 minutes.

A further important aspect, which is to be heeded in particular when producing paper webs with multiple-copy sheets whereby several identical feature patterns are regularly incorporated simultaneously, is that the pressure at which the feature substance suspension is directed onto the paper web in different places is identical in each case. For this purpose it is provided that a great number of up to several hundred connecting pipes branch off from the closed, continuously conveyed feature substance suspension circuit to nozzles from which feature substance suspension is directed onto the paper sheet in laminar jets. This necessarily involves a pressure loss in the closed circuit. Like the pressure loss through the flow resistance of the circuit, it means that an individual suspension pressure or connecting pipe inlet pressure is present depending on the place where the connecting pipe leading to the nozzle branches off from the circuit, said pressure having to be reduced up to the nozzle just so far that the same outlet pressure is present at all nozzles used for producing similar patterns. This can be realized for example by a special control device in each connecting pipe. A simpler and therefore preferred solution, however, is to select the length and/or diameter of the connecting pipes so that the pressure loss in the connecting pipes is just so high that the nozzle outlet pressure is identical in each case.

The connecting pipe inlet pressure depends, on the one hand, on how high the maximum suspension pressure in the closed circuit is and, on the other hand, on how high the pressure loss in the circuit is up to the branching-off of the connecting pipe in question. Said pressure loss in turn depends directly on the rate at which the feature substance suspension is conveyed within the circuit. Preferably, the feed or circulating pump is operated at high and constant delivery to produce a circulation rate as high as possible and thus a turbulent flow which prevents sedimentation of the feature particles while simultaneously achieving uniform intermixture of the suspension. Maintaining the circulating pump delivery constant ensures constant conditions in the pipes and nozzles during operation. The operability and effect of the pump is monitored by monitored by measurement of a pressure difference. For this purpose the pressure in the circuit can be measured before and after the connecting pipe branches and the delivery of the circulating pump inferred from the differential pressure measured. Both wear of the circulating pump due to abrasive properties of the suspended particles and a reduction in cross-sectional area or clogging due for example to deposits in the pipes or filters of the circuit lead to a decrease in the pressure difference measured in the circuit. Monitoring of the pressure difference thus permits countermeasures to be taken in time.

A control device is preferably provided for maintaining the maximum or absolute suspension pressure in the circuit constant. For this purpose the absolute pressure is measured at a suitable place in the volume and the quantity of suspending medium supplied to the volume controlled by a feed pump. Although feature suspension is continuously removed from the volume via the nozzles, the essential parameters remain constant in the volume and thus also on the nozzles.

Alternatively, the conveyed or circulated quantity can be monitored and maintained constant, instead of the pressure in the removing volume. In this case, suspension fractions withdrawn from the volume are also compensated for and constant conditions ensured. Pressure control has the advantage, however, that it ensures that the same quantity of suspension leaves each nozzle if the nozzles are the same, regardless of the number of open nozzles. This is of advantage in particular when a fast change is to be made in the coding produced in the paper with the suspension jets while paper web production is underway.

It is important for the operability of the apparatus for applying feature substance suspension to the paper web that there are no deposits, in particular of feature substances, in individual elements of the apparatus since this can have an adverse effect on the pressure relations in the apparatus and thus on the uniformity of the produced feature patterns. Therefore it is provided that the feature substance suspension is produced in the desired concentration substantially only in the volume from which the connecting pipes branch off to the jet outlet nozzles, i.e. only in the closed circuit system in the case of the specific preferred embodiment. A feature substance concentrate and the suspending medium are therefore supplied to the circuit separately, preferably locally before the pump for circulating feature substance suspension in the closed cirsuspension in the closed circuit, so that said circulating pump performs the function of mixing the feature substance concentrate with the suspending medium.

In addition it is advantageous to provide a degassing device for degassing the suspending medium before it is supplied to the volume. This ensures, among other things, that the suspension does not emit gas and form bubbles, in particular upon a drop in pressure. In the degassed medium, air bubbles already present in the feature substance suspension can also dissolve again. If such air bubbles were discharged from the nozzles with the feature substance suspension, this would have an adverse effect on the contour and concentration distribution of feature substance at this place in the finished paper. For similar reasons the connecting pipes are preferably connected to the volume from above and protrude into the volume so that any air bubbles contained in the volume cannot pass into the connecting pipes and in addition no feature substances sedimented in the volume can pass into the connecting pipes and block them. In particular with especially high-density feature substances there is the danger of some larger particles being deposited on the bottom of the volume.

In preferred embodiments, shut-off devices are provided between the discharge points of the suspension from the buffer volume and the nozzles to permit each individual nozzle to be switched on and off individually. The shut-off devices can be for example stopcocks or valves which are controlled manually or automatically and actuated manually, electrically or pneumatically. This makes it possible to produce in a paper web an individual or regularly recurring feature pattern, which can also consist of interrupted tracks and also render coded information. In particular with automatically controlled switching apparatuses one can produce feature patterns whose application or incorporation in the paper web is synchronized with marks located thereon. In a preferred embodiment, said marks are formed by watermarks present in the paper.

BRIEF DESCRIPTION OF THE DRAWING

In the following, the invention will be explained by way of example with reference to a diagrammatic drawing showing an inventive apparatus in a paper machine.

DESCRIPTION OF THE PREFERRED EMBODIMENTS

Only a tiny detail of the paper machine is shown, namely the end of mold 1. Paper web 2, shown by dash lines, leaves mold 1 in the direction of the arrow. In this state, paper web 2 is already largely consolidated but still moist. Paper web 2 leaving mold 1 is transported further and guided under nozzle rail 10. Through nozzles 11 a feature substance suspension is directed onto the moist paper web from above in order to produce linear feature patterns in the paper web parallel to the outside edge of the paper web. Several hundred nozzles 11 can be provided side by side which are individually activable and deactivable via associated stopcocks 12. Following nozzles 11 in the transport direction of the paper web is suction device 3 which is provided under paper web 2 to suck feature substance suspension applied to paper web 2 by nozzles 11 through paper web 2 so that only the feature substances are left in the paper. As indicated by the Figure, said suction device can already begin before nozzles 11 in the transport direction of the paper web. Paper web 2 is then supplied optionally to following processing stations (not shown) for drying, coating, printing and the like.

The apparatus for incorporating feature substances into paper web is composed substantially of four subsystems. The core element of the apparatus is a volume preferably defined as a closed circuit 13 of nozzle rail 10 formed as a pipe system and having centrifugal pump 14 as a circulating pump for continuously conveying feature substance suspension within the pipe system. The second subsystem is formed by water preparation and supply unit 20, and the third subsystem by feature substance concentrate preparation and supply unit 30. The fourth subsystem is formed by nozzles 11 and their connecting pipes 15 to closed circuit 13 of nozzle rail 10. The various subsystems will be described in detail below.

Feature substances are held ready as feature substance concentrate in a storage vessel. Through cover opening 32 feature substances are supplied to vessel 31 in pulverized form. Water is supplied via blockable feed pipe 33. Water and feature substances are mixed by agitator 34, and the feature substance concentration is preferably in the range of 10 to 30 wt %, in particular 0.4 kg of feature substance for 1 liter of water. The exact concentration value in the storage vessel is relatively uncritical since the final concentration of the feature substance suspension directed onto paper web 2 by nozzles 11 is only adjusted in closed circuit 13 by admixture of water. The higher the concentration in the storage vessel, the greater the feature supply and thus the time period until the storage vessel is refilled. The fill level of the storage vessel is monitored with level gage 35. However, the concentration in the storage vessel must not exceed a predetermined viscosity limit of the feature concentrate since this otherwise this otherwise impairs the feed of feature concentrate by means of metering pump 36 preferably formed as a diaphragm pump. At the abovementioned concentration values the feature substance suspension is still very liquid, almost like water, for most feature substances. Via feed pipe 38, metering pump 36 finally pumps feature substance concentrate out of storage vessel 31 into closed circuit 13 of nozzle rail 10.

Prepared water is in addition supplied to closed circuit 13 via feed pipe 28. The water is previously degassed in vacuum vessel 21 holding for example 20 liters at a negative pressure of approximately 0.3 bars relative to ambient pressure, so that any air bubbles passing into closed circuit 13 with the feature substance concentrate for example can dissolve in the feature substance suspension of closed circuit 13. The vacuum vessel is equipped with vacuum pump 27 and level gage 25 which ensures that the fill level is maintained at about 90% of capacity for safety reasons. A feed pump executed for example as gear pump 26 conveys prepared water out of vacuum vessel 21 via feed pipe 28 to closed circuit 13. The maximum delivery of gear pump 26 is for example about 550 liters an hour, which suffices for supplying about 300 nozzles simultaneously with a throughput of about 1.7 liters an hour per nozzle. Water treatment and supply unit 20 preferably has a water deliming device additionally integrated therein, which is not shown in the Figure.

Closed circuit 13 is formed substantially by a closed pipe system with integrated centrifugal pump 14 for circulating feature substance suspension conveyed in closed circuit 13. Feature substance concentrate and prepared water are supplied to closed circuit 13 via feed pipes 38, 28 shortly before centrifugal pump 14. Centrifugal pump 14 thus performs the function of intermixing supplied feature substance concentrate with supplied prepared water. This guarantees that the concentration distribution of feature substances in the feature substance suspension is homogeneous to a very large extent before feature substance suspension fractions are branched off from circuit 13 via connecting pipes 15 to nozzles 11. Strainer 16 with a 100 micron steel screen is provided shortly after the centrifugal pump and retains particles which could lead to clogging of nozzles 11. Stopcock 17 is provided for example on the strainer screen for ventilating the apparatus after it is switched on.

Closed circuit 13 has two control circuits, a pressure control circuit and a density control circuit.

The pressure control circuit includes two pressure sensors $P_1$ and $P_2$ at different places in closed circuit 13, preferably at a place before the branchings-off of connecting pipes 15 to nozzles 11 and at a following place in the direction of circuit flow. Pressure $p_1$ can be for example between 500 and 800 millibars depending on the pipe lengths and cross sections. Deviations from this set point are measured and used for controlling gear pump 26 for conveying the prepared water so that set point $p_1$ is maintained. Pressure value $p_2$ is preferably measured after the branching-off of last connecting pipe 15 to last nozzle 11 to determine the drop in pressure arising due to the branched-off feature substance suspension fractions and the flow resistance of the pipes in closed circuit 13. Said drop in pressure should always be constant to ensure that roughly the same pressure relations always prevail at all nozzles 11 regardless of the number of nozzles activated. Since pressure difference $p_2-p_1$ is directly dependent on the flow rate of feature substance suspension in closed circuit 13, differential pressure measured value $p_2-p_1$ is used to monitor the delivery of centrifugal pump 14.

The density control circuit includes density sensor ρ. The inlet of density sensor ρ is connected directly to closed circuit 13 directly after strainer 16. The outlet of density sensor ρ is located on the opposite side shortly before the inlet to centrifugal pump 14. The pressure drop between inlet and outlet ensures sufficient flow through density sensor ρ which prevents deposits from forming in density sensor ρ. Density sensor ρ is used to determine the actual density of feature substance suspension in closed circuit 13. This is a measure of the concentration of feature substances in the feature substance suspension of closed circuit 13. According to the information on the actual density of feature substance suspension provided by density sensor ρ, metering pump 36 on storage vessel 31 is controlled to adjust a predetermined set point of suspension density corresponding to a concentration of a feature substance. A typical density adjustment for metering feature substances in feature substance suspension is e.g. 0.1 to 0.5 wt %.

The aforementioned measures ensure that not only the same feature substance concentration is present in the feature substance suspension at every branching-off of connecting pipe 15, but also a time-constant connecting pipe inlet pressure, although it varies from connecting pipe to connecting pipe. On these premises the same connecting pipe outlet pressure can be adjusted for all pipes by simple constructional design of design of the connecting pipes, by producing a defined pressure loss in each connecting pipe 15 by suitable choice of the diameter and/or preferably the length of connecting pipes 15, so that the same pressure is present at the end of each connecting pipe, that is, at nozzles 11. To achieve the same outlet pressure for all nozzles 11 for example at pressure $p_1$ in the range of 500 to 800 millibars and an accordingly lower value for $p_2$ in closed circuit 13, connecting pipes 15 with a length of typically a few decimeters have proved suitable, the connecting pipes consisting for example of tubes with an inside diameter of about 1 millimeter.

Each connecting pipe 15 has individual stopcock 12. However, the blockage of individual stopcocks 12 has no effect on throughput and nozzle outlet pressure, since the connecting pipe inlet pressure is maintained roughly constant by the above-described pressure control regardless of the number of active nozzles.

Stopcocks 12 can be replaced by shut-off valves. An electric or pneumatic drive (not shown in the Figure) of the shut-off devices is advantageous in particular for frequent or fast change of the produced coding patterns. Altogether several hundred nozzles can be disposed side by side, also offset, at a distance of about 3 to 15 millimeters.

It should also be mentioned that connecting pipes 15 are connected to closed circuit 13 from above to prevent larger feature substance particles deposited on the bottom of closed circuit 13 from being sucked in, which could lead to clogging of the components such as stopcocks, nozzles, etc. In addition, connecting pipes 15 protrude from above about 10 millimeters into closed circuit 13 to prevent any air bubbles from being discharged through nozzles 11 with feature substance suspension, which would have an adverse effect on the quality of the stripe pattern produced.

The above-described apparatus for incorporating feature substances into a paper web permits a great variety of line codings by activating and deactivating individual nozzles 11 using respective associated stopcocks 12 without this having an effect on the feature substance concentration of the individual lines ultimately present in the finished paper. This is essentially due to the special pressure control circuit wherein the absolute pressure in the volume, e.g. pressure $p_1$, is measured in closed circuit 13 before the branching-off of connecting pipes 15 and pressure $p_2$ after branching-off of connecting pipes 15, each being maintained at a constant value by control of the deliv-delivery of gear pump 26. The advantages achieved by said pressure control circuit are also achieved when the feature substance suspension is directed onto the surface of the paper web not as a laminar jet with low jet pressure but for example with high jet pressure or as a turbulent jet or sprayed jet.

What is claimed is:

1. An apparatus for incorporating feature substances into a paper web at a place in a paper machine where a bulk of the liquid is already withdrawn from the original paper pulp such that the paper web is still moist but already consolidated, comprising:

a volume for receiving a feature substance suspension comprising a feature substance suspended in a suspending medium;

one or more nozzles communicating with the volume;

a device for controlling a pressure at which a feature substance suspension fraction withdrawn from the volume is directed onto the paper web through the nozzles, the feature substance suspension fraction having a low pressure at an inlet side of the nozzles; and a suction device for sucking the suspending medium through the paper web, the suction device located on a side of the paper web opposite the nozzles and following the nozzles in the transport direction of the paper web;

wherein the pressure control device and the nozzles are so formed and mutually coordinated that the feature substance suspension fraction is adjustable as a laminar jet leaving the nozzles.

2. The apparatus according to claim 1, wherein the pressure control device has at least a pressure-measuring device and a device arranged to increase the pressure in the volume.

3. The apparatus according to claim 1, wherein the jet pressure at the nozzle inlet is in the range of 30 millibars to 200 millibars.

4. The apparatus according to claim 3, wherein the jet pressure at the nozzle inlet is in the range of 50 millibars to 100 millibars.

5. The apparatus according to claim 1, comprising a conveying device arranged to convey the feature substance suspension within the volume.

6. The apparatus according to claim 5, wherein the volume forms a closed circuit.

7. The apparatus according to claim 5, wherein pipes are connected between the nozzles and the volume, and are disposed one after the other in the conveying direction of the feature substance suspension and wherein the pressure control device has a first pressure sensor before the connecting pipes in the conveying direction and a second pressure sensor after the connecting pipes in the conveying direction arranged to adjust a desired pressure with reference to the measured pressure values in the volume and to monitor a desired pressure loss.

8. The apparatus according to claim 7, wherein at least some of the connecting pipes cause a different pressure loss at the same flow volume so as to cause roughly the same outlet pressure despite a different inlet pressure of the feature substance suspension fraction directed through them.

9. The apparatus according to claim 8, wherein a different pressure loss in the connecting pipes is caused by different lengths and/or diameters of the connecting pipes.

10. The apparatus according to claim 7, wherein shut-off devices are provided in the pipes.

11. The apparatus according to claim 9, including pipes connecting the nozzles with the volume, said pipes connected to the volume from above.

12. The apparatus according to claim 1, comprising feed pipes arranged to separately supply a feature substance concentrate, on the one hand, and a suspending medium, on the other hand, into the volume.

13. The apparatus according to claim 12, comprising a degassing device arranged to degas the suspending medium before it is supplied to the volume.

14. The apparatus according to claim 1, wherein the nozzles are formed as solid jet or flat jet nozzles.

15. A paper machine for producing a paper web from a fibrous-pulpy paper pulp, comprising an apparatus according to claim 1.

16. The paper machine according to claim 15, wherein the nozzles are directed onto the paper web after a mold in the transport direction of the paper web.

* * * * *